United States Patent [19]

Willems

[11] Patent Number: 4,945,568

[45] Date of Patent: Jul. 31, 1990

[54] METHOD OF AND DEVICE FOR DERIVING FORMANT FREQUENCIES USING A SPLIT LEVINSON ALGORITHM

[75] Inventor: Leonardus F. Willems, Eindhoven, Netherlands

[73] Assignee: U.S. Philips Corporation, New York, N.Y.

[21] Appl. No.: 128,669

[22] Filed: Dec. 4, 1987

[30] Foreign Application Priority Data

Dec. 12, 1986 [NL] Netherlands ..... 8603163

[51] Int. Cl.[5] ..... G10L 9/04

[52] U.S. Cl. ..... 381/50

[58] Field of Search ..... 381/50, 39, 41–45, 381/36–38; 364/513.5

[56] References Cited

U.S. PATENT DOCUMENTS 4,346,262 8/1982 Willems et al. ..... 381/50

4,477,925 10/1984 Avery et al. ..... 381/43

OTHER PUBLICATIONS

Delsarte et al., "The Split Levinson Algorithm", IEEE Trans. on ASSP , vol ASSP-34, No. 3, 6/86, pp. 470–478.

*Primary Examiner*—Gary V. Harkcom
*Assistant Examiner*—John A. Merecki
*Attorney, Agent, or Firm*—Bernard Franzblau

[57] ABSTRACT

A method of and a device for deriving formant frequencies from a part of a speech signal. For determining the formant frequencies from a part of a speech signal located within a given time interval, the Split Levinson algorithm is used. In the Split Levinson algorithm a higher order singular predictor polynomial ($P_k(z)$) is each time determined in successive recursion steps. After the last recursion step the formant frequencies ($f_1$, $f_2$, . . . ) are determined.

9 Claims, 2 Drawing Sheets

METHOD OF AND DEVICE FOR DERIVING FORMANT FREQUENCIES USING A SPLIT LEVINSON ALGORITHM

BACKGROUND OF THE INVENTION

This invention relates to a method of determining formant frequencies from a part of a speech signal located within a given time interval, in which for successive instants located within the time interval a parameter value is derived from the part of the speech signal located within the time interval, a polynomial of a given order is determined from the parameter values, the formant frequencies are derived from the given polynomial. The invention, also relates to a device for performing the method.

A method of and a device for deriving the formant frequencies in a speech signal is described in U.S. Pat. No. 4,346,262 (8/24/82), which is hereby incorporated by reference.

Formants are actually the resonances of the vocal cords and are characterized by much energy in the spectrum. During speaking the vocal cords constantly change their shape and hence the formants also change as far as the location on the frequency axis and the bandwidth are concerned. In a source filter model for speech production a description of the filter in terms of format frequencies and bandwidths is frequently used. The speech analysis for the Philips' speech synthesis chips MEA 8000 and PCF 8200 also uses a formant description of the speech signal, see list of literature (1) and (2). The reasons for using a formant description are:

economical coding is possible, data to be interpreted physically are concerned so that manipulation provide an insight, such as for example concatenation of diphone segments and editing for the speech synthesis chip.

The description above gives the impression that the speech signal could always be described by means of a number of formants (=resonances). In that case the filter in the source filter model only comprises resonances (all pole filter). In running speech the speech production system does not always comply with this model: there are sounds for which the model should comprise fewer formants or there are sounds for which the model, besides comprising formants, should also comprise zeros (that means antiresonances: this is a frequency range in which a phenomenon contrasting with resonance occur so that the signal is not subjected to a resonant rise but is notched, and in which there is locally little energy in the spectrum). However, in a practical system the structure of the source filter model and hence the numbers of formants is laid down. The fact that the model used is not adapted to all actually occurring situations causes an operational definition to be given to the formants in the case of speech synthesis. The speech synthesis filter only comprises a fixed number of formants (and no zeros) and the associated speech analysis is assigned to find the model parameters independently of the suitability of the model for speech production.

A formant analysis is extensively described in (3). Two problems occur in this formant analysis:

the prescribed number of formants is not always found, occasionally the analysis fails for numerical reasons: the algorithm used does not converge.

SUMMARY OF THE INVENTION

It is an object of the invention to provide a method of and a device for performing the method in which the prescribed number of operationally defined formants can be determined in all cases, while using an algorithm converging in all cases.

To this end the method according to the invention is characterized in that a Split Levinson algorithm is performed in each of a number of successive recursion steps to determine a singular predictor polynomial (SPP) from the parameter values. The singular predictor polynomial determined in a recursion step has a higher order than the singular predictor polynomial determined in a preceding recursion step. After the last recursion step the formant frequencies are derived from the singular predictor polynomial obtained in the last recursion step. The method may be further characterized in that in a recursion step the zeros of the singular predictor polynomial determined in this recursion step are derived, by using the zeros calculated during the previous recursion step and, after the last recursion step, the formant frequencies are derived from the zeros obtained in the last recursion step. The determination of the zeros of the singular predictor polynomials is simpler than the determination of the zeros in accordance with the known method. The zeros of the polynomial obtained in accordance with the known method are located within the unit circle, whereas the zeros of a singular predictor polynomial are located on the unit circle. As a result, the zeros can be calculated in a simpler manner and sufficient zeros are always found so that actually a robust method of determining formant frequencies is obtained.

The method may be further characterized in that for each of the formant frequencies thus found, the associated bandwidth is determined, starting from the parameter values and the calculated formant frequencies, by means of a minimizing algorithm. All quantities required to generate synthetic speech are then derived, as is already done with the previously mentioned speech chips MEA 8000 and PCF 8200.

The device for performing the method comprises an input terminal for receiving a speech signal, a first unit for deriving for successive instants located within the time interval a parameter value from the part of the speech signal located within said time interval, having an input coupled to the input terminal, and an output, a second unit for determining a polynomial of a given order from the parameter values, having an input coupled to the output of the first unit, and an output, and a third unit for deriving the formant frequencies from the given polynomial, having an input coupled to the output of the second unit and an output for supplying the formant frequencies. The device in accordance with the invention is characterized in that the second unit is adapted to perform a Split Levinson algorithm in each recursion step to derive a singular predictor polynomial from the parameter values, the singular predictor polynomial derived in a recursion step having a higher order than the singular predictor polynomial determined in a preceding recursion step, and in that the third unit is adapted to derive the formant frequencies from the singular predictor polynomial obtained in the last recursion step.

The second unit may be further adapted to derive in a recursion step the zeros of the singular predictor polynomial determined in this recursion step, using the zeros calculated during the previous recursion step, and the third unit is adapted to derive the formant frequencies from the zeros obtained in the last recursion step. If, in addition to the formant frequencies obtained in the manner described above, the bandwidths are also to be determined, the third unit may to this end be adapted to determine the associated bandwidth for each of the formant frequencies thus found, starting from the parameter values and the calculated formant frequencies, by means of a minimizing algorithm.

BRIEF DESCRIPTION OF THE DRAWINGS

The invention will now be described in greater detail, by way of example, with reference to the accompanying drawings, in which.

DESCRIPTION OF THE PREFERRED EMBODIMENTS

In the known method the formants are determined by calculating an all pole filter with the aid of the LPC analysis, which is subsequently analyzed into second-order sections. The LPC analysis is a method known from the literature, see for example Reference (5). In the LPC analysis a part of a signal of approximately 25 ms is taken and it is multiplied by a Hamming window and the auto correlation coefficients are calculated. A polynomial A(z) (1/A(z)=the all pole filter) of a given order is now determined by means of the so-called Levinson algorithm. This is a recursive algorithm in which for each recursion step an A-polynomial is calculated whose zeros are located within the unit circle.

Successively:

$$A_o(z)=1 \tag{1.1}$$

$$A_1(z)=1+a_{1.1}z^{-1} \tag{1.2}$$

$$A_2(z)=1+a_{2.1}z^{-1}+a_{2.2}z^{-2} \tag{1.3}$$

$$A_m(z)=1+a_{m.1}z^{-1}+\ldots+a_{m.m}z^{-m} \tag{1.4}$$

Figure 1:
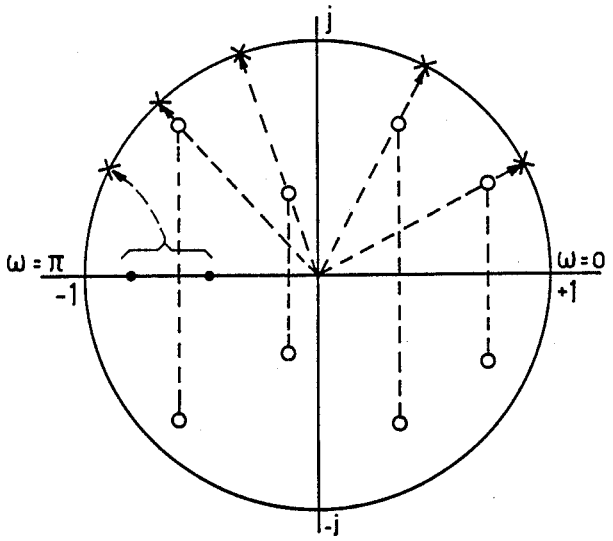
FIG. 1 shows zeros of the A filter from the LPC analysis, located within the unit circle, and zeros of the singular predictor polynomial located on the unit circle.

With each recursion the A polynomial changes completely. The fact that the zeros are always located within the unit circle ensures a stable synthesis filter and is a result of the use of the auto correlation method. The zeros of this polynomial are complex conjugate pairs or real zeros, see FIG. 1. In FIG. 1 the open circles indicate the complex conjugate pairs and the closed circles indicate the real zeros. The zero pairs (including the real ones) can be written as:

$$N(z)=1+pz^{-1}+qz^{-2} \tag{2}$$

If the A polynomial A(z) is written as:

$$A(z)=1+a_1z^{-1}+\ldots+a_mz^{-m} \tag{3}$$

it can be analyzed in second-order sections:

$$A(z)=\prod_{j=1}^{M/2} N_j(z^{-1})=\prod_{j=1}^{M/2}(1+p_jz^{-1}+q_jz^{-2}$$

These ($p_j$, $q_j$) pairs can be split off by means of the so called bairstow algorithm which is known from the Handbook, see, inter alia Reference (6).

Added complex zero pairs represent a resonance (=formant) and the $p_j$, $q_j$ numbers give the formant frequency and bandwidth as follows:

$$P_j=-2.\exp(-\pi B_jT).\cos(2\pi F_jT) \tag{5a}$$

$$q_j=\exp(-2\pi B_jT) \tag{5b}$$

in which $T=1/F_s$ is the sampling period from which $B_j$ and $F_j$ can be determined.

Real zeros cannot be transformed to formant data because they do not describe any resonance, but rather give the spectrum a certain slope.

The two problems, mentioned in the opening paragraph, in the current formant determination can now be better formulated:

the presence of real zeros of the A-polynomial so that no formant frequency and bandwidth can be determined, the occasional failure of the bairstow-algorithm for numerical reasons which are not really known. The algorithm then remains iterating without converging.

The so-called Split Levinson algorithm has been developed by Genin and Delsarte (4) and one of its properties is that approximately half the number of multiplications is required to perform an LPC analysis as compared with the conventional Levinson algorithm. This is possible because the so-called singular predictor polynomials are now used instead of the A-polynomials. These predictor polynomials are symmetrical and therefore the zeros are located on the unit circle and, roughly speaking, these polynomials thus consist of half as many significant coefficients.

The attractive feature of this algorithm resides in the properties of the singular predictor polynomials (SPP). The SPP are defined by $$P_k(z)=A_{k-1}(z)+z^{-1}\hat{A}_{k-1}(z) \tag{6}$$

in which $A_k(z)$ is the A-polynomial at the k-th recursion of the normal Levinson algorithm and in which it holds for $\hat{A}_k(z)$ that:

$$\hat{A}_k(z)=z^{-k}.A_k(z^{-1}) \tag{7}$$

$\hat{A}_k(z)$ is the reciprocal polynomial of $A_k(z)$.

As stated, these SPP are symmetrical polynomials and therefore they have zeros which are located on the unit circle and not within this circle, as is the case with the $A_k(z)$.

These SPP are also related to the polynomials which play a role in the LSP analysis (Line Spectrum Pairs) (7). Based on the definition and the properties of $A_k(z)$ a recurrent relation can be derived for the SPP:

$$P_k(z)=(1+z^{-1})P_{k-1}(z)-a_{k-1}z^{-1}P_{k-2}(z) \tag{8}$$

in which $\alpha_{k-1}$ is a number calculated from the given auto correlation coefficients.

It is known (7) that the position of the zeros on the unit circle of this SPP, and having an even valued order, lie in the proximity of the formant positions as are derived from the A polynomial. This similarity is the better as the pole is located closer to the unit circle, or in other words the bandwidth of the formant is smaller. According to the invention the formant frequencies are now derived from the positions of the zeros of the singular predictor polynomial on the unit circle. This simplifies the problem of finding the zeros of the A-polynomial, which may be located anywhere within the unit circle, and of finding the zeros of the singular predictor polynomial which are located on the unit circle, see the crossed points on the unit circle in FIG. 1. Finding these zeros of the singular predictor polynomial is still further simplified because the zeros in the successive recursion steps shift quite systematically.

The recursion steps are traversed in the following manner. In the first recursion step $P_o(z)=1$ is taken. In the second recursion step $P_1(z)=1+z^{-1}$. This follows directly from the formulae (1.1), (6) and (7). The zero $np_{1.1}$ of this polynomial is located at $z^{-1}=-1$ or $w=\pi$, in which w is the argument of the (complex) zero. In the third recursion step $P_2(z)$ is calculated, using the formula (8):

$$P_k(z)=(1+z^{-1})P_{k-1}(z)-\alpha_{k-1}z^{-1}P_{k-2}(z) \quad (8)$$

in which $$\alpha_{k-1}=\tau k-1/\tau_{k-2} \quad (9)$$

$$\tau_{k-1}=(r_o+r_{k-1})+(r_1+r_{k-2})p_{k-1.1}+ \quad (10)$$

and $p_{k.i}$ follows from the general formula for $P_k(z)$ namely $$P_k(z)=1+p_{k.1}z^{-1}+p_{k.2}z^{-2}+\ldots +p_{k.1}z^{-k+1}+z^{-k} \quad (11)$$

or $$P_2(z)=1+p_{2.1}z^{-1}+z^{-2}$$

For calculating $P_2(z)$ it thus holds that $$p_{k-1.1}=p_{k-1.2}=\ldots=0$$

and thus $$\tau_1=r_o+r_1$$

Moreover $\tau_o=r_o/2$ is chosen.

Consequently $P_2(z)$ becomes:

$$\begin{aligned} p_2(z) &= (1+z^{-1})^2-\alpha_1 z^{-1} \\ &= 1+(2-\alpha_1)z^{-1}+z^{-2} \\ &= z^{-1}\{(2-\alpha_1)+(z^{-1}+z)\} \end{aligned}$$

If $z=e^{jw}$ is substituted, which means that $z+z^{-1}=2\cos w$, then:

$$P_2(z)=e^{-jw}\{(2-\alpha_1)+2\cos w\}$$

The second degree polynomial $P_2(z)$ is now reduced to a first degree polynomial with zeros in the interval $(-1,+1)$ instead of on the unit circle.

Figure 2:
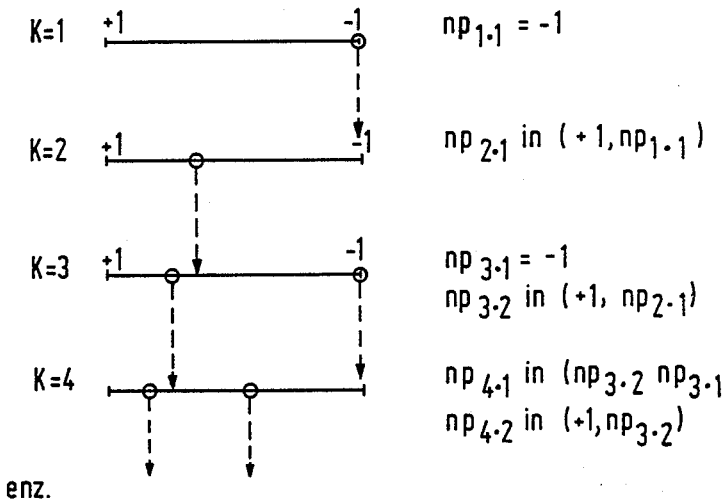
FIGS. 2 and 3 show the behaviour of the zeros obtained for successive recursion steps in the Split Levinson algorithm.

We find a zero $np_{2.1}$ which is located in the interval determined by $np_{1.1}$ $(=-1)$ and $+1$, see FIG. 2.

Subsequently $P_3(z)$ is calculated in the fourth recursion step, using the formulae (8), (9), (10) and (11). An equation is found in the form of:

$$\begin{aligned} p_3(z) &= 1+p_{3.1}z^{-1}+p_{3.1}z^{-2}+z^{-3} \\ &= (1+z^{-1})[1+(p_{3.1}^{-1})z^{-1}+z^{-2}] \end{aligned}$$

This equation can be divided by $1+z^{-1}$ which yields a zero $np_{3.1}$ at $z^{-1}=-1$, or $w=\pi$.

What remains is again a second degree comparison which can be converted in the manner as described with reference to $P_2(z)$. Then a zero $np_{3.2}$ is found which is located in the interval determined by $np_{2.1}$ and $+1$, see FIG. 2.

Subsequently, $P_4(z)$ is calculated in the fifth recursion step, using the formulae (8), (9), (10) and (11):

$$\begin{aligned} p_4(z) &= 1+p_{4.1}z^{-1}+p_{4.2}z^{-2}+p_{4.1}z^{-3}+z^{-4} \\ &= z^{-2}(z^2+p_{4.1}z+p_{4.2}+p_{4.1}z^{-1}+z^{-2}) \\ &= z^{-2}[(z^2+z^{-2})+p_{4.1}(z+z^{-1})+p_{4.2}] \end{aligned}$$

If $z=e^{jw}$ is substituted again then $$z+z^{-1}=2\cos w \text{ and } z^k+z^{-k}=2\cos kw$$

$$P_4(z)=e^{-2jw}[2\cos 2w+2p_{4.1}\cos w+p_{4.2}]$$

And this can always be written in powers of $y=\cos w$; in this case with $\cos 2w=2\cos^2 w-1$.

$$P_4(z)=e^{-2jw}[4y^2+2p_{4.1}y+(p_{4.2}-2)]$$

The fourth-degree polynomial $P_4(z)$ is now reduced to a-second degree polynomial with zeros at the interval $(-1,+1)$ again instead of on the unit circle. Particularly there is a zero $np_{4.1}$ between $np_{3.1}$ and $np_{3.2}$ and there is a zero $np_{4.2}$ between $np_{3.2}$ and $+1$, see FIG. 2.

Summarizing:

In the Split Levinson algorithm the SPP in the successive recursion steps are as follows:

$$k=0 \quad P_0(z)=1$$

$$k=1 \quad P_1(z)=1+z^{-1}$$

$$k=2 \quad P_2(z)=1+p_{2.1}z^{-1}+z^{-2}$$

$$\begin{aligned} k=3 \quad P_3(z) &= 1+p_{3.1}z^{-1}+p_{3.1}z^{-2}+z^{-3} \\ &= (1+z^{-1}(1+p_{3.1}^{-1})z^{-1}+z^{-2}) \end{aligned}$$

$$k=4 \quad P_4(z)=1+p_{4.1}z^{-1}+p_{4.2}z^{-2}+p_{4.1}z^{-3}+z^{-4}$$

and so forth.

It is a property of this SPP $P_k(z)$ that the zeros of $P_k(z)$ are located in an interval which can be derived from the zeros of $P_{k-1}(z)$. See FIG. 2: for $k=1$ the zero $np_{1.1}=-1$, for $k=2$ the zero is located in the interval $(np_{1.1}, +1)$. For $k=3$ one zero $np_{3.1}=-1$ and the other zero $np_{3.2}$ is located in the interval $(np_{2.1}, +1)$, etcetera.

Figure 3:
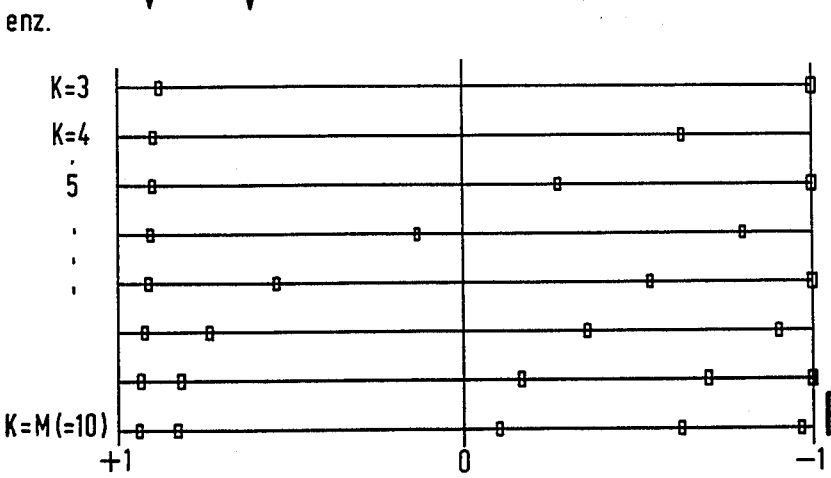

Finding a zero in an interval of which only one is known to be present always leads to success. In the algorithm the positions of the zeros are determined from the start (from k=3), see also FIG. 3.

The formant frequencies are calculated in the following manner from the zeros determined in the last recursion step. Since a zero $np_{1,j}$ indicates the length of the projection on the horizontal axis (see FIG. 1) of the unit vector towards a given point on the unit circle, it holds that:

$$np_{i,j}=\cos(2\pi f_j T)$$

in which $T=1/f_s$ is the sampling period and $f_s$ is the sampling frequency.

It follows that the formant frequency $$f_j=f_s \arccos(np_{i,j})/2\pi$$

in which j ranges from 1 to ½M inclusive and i is equal to M.

The number M is determined by the number of formants which is expected within the frequency range to be analyzed. If the bandwidth of the frequency range to be analyzed is, for example 5000 Hz, five formants for a male voice and four formants for a female voice are located within this range. In this case M is 10 and 8, respectively. If the bandwidth is, for example 8000 Hz, 8 formants for a male voice and 6 formants for a female voice are located within this frequency range. M is now 16 and 12, respectively. It may be evident that M is thus taken to be equal to twice the expected number of formants within the frequency range.

The bandwidth information in the formant frequencies thus found must now be determined. This problem is solved by using a minimizing technique, with the bandwidths as unknowns. To this end a choice for each formant is made from the table of possible bandwidths. From this table an A-polynomial can be calculated which can be checked to find out how well this polynomial fits the incoming signal. Hence we can also calculate which choice from the table fits best with the incoming signal. The fit between an a-filter and the incoming signal can now be determined by means of the auto correlation coefficients (already calculated). Let it be assumed that $\bar{A}(z^{-1})$ is the $\bar{a}$ filter which has been found by choosing a value from the available table for all, still unknown bandwidths. Then the error made is $$E = \sum_n \left( s_n + \sum_{k=1}^{M} a_k s_{n-k} \right)^2 = \sum_n \left( \sum_{k=0}^{M} a_k s_{n-k} \right)^2 \text{ with } a_o = 1$$

This can be reduced to $$E = \sum_{k=0}^{M} a_k^2 r_k^2 + 2 \sum_{k=0}^{M} a_k \sum_{j=k+1}^{M} a_j r_{k-j}$$

in which $$r_k = \sum_{j=1}^{n-k} s_j \cdot s_{j+k};$$

which are the auto correlation coefficients which have already been calculated and have also served as an input for the Split Levinson algorithm.

In the minimizing algorithm the minimum of the error is sought for the bandwidth of the first formant, subsequently for the second formant, and so forth, and then again for the first formant, and so forth. This process is repeated until the bandwidth values do not change anymore. The values for the bandwidths are taken from a table with a given quantization. This quantization was tested with different step sizes without the convergence ever failing. The sequence in which the minimization is effected (in this case successively for formants 1, 2, 3, 4 and 5) is important for the rate of convergence.

Figure 4:
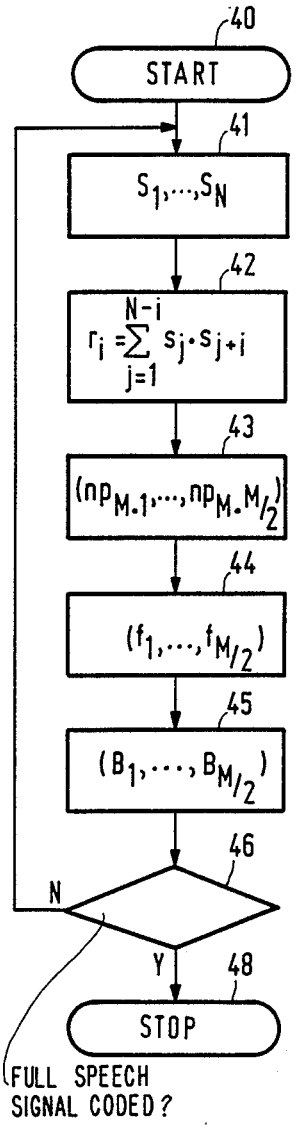
FIG. 4 shows a flow chart of the method.

FIG. 4 shows a flow chart of the method according to the invention. The method is started in block 40. In block 41 a part of the speech signal located in a given time interval of, for example, 25 ms is inputted. The signal is processed under the influence of a Hamming window. Subsequently auto correlation coefficients $r_i$ (i=O, . . . , M) in which M<<N are calculated from the then obtained samplings $S_1, \ldots S_N$ in the block 42. In block 43 the Split Levinson algorithm is used, starting from the auto correlation coefficients $r_i$. After a number of recursion steps, namely M steps, in the Split Levinson algorithm the zeros $np_{M.1}, np_{M.2}, \ldots, np_{M.\frac{1}{2}M}$ (M is even) are found. Subsequently the formant frequencies $f_1 \ldots f_{M/2}$ are derived in the block 44 from the zeros obtained in the last recursion step. Then the bandwidths $B_1$ to $B_{M/2}$ associated with the formant frequencies are derived in block 45. Then the programme returns via the chain 46, 47 to block 41 and a speech signal is taken in from a time interval (of 25 ms) shifted over a given time interval (of, for example 10 ms), from which signal a set of formant frequencies with the associated bandwidths can be derived again. The programme is thus repeated every time until the full speech signal has been coded. The programme then ends via 46 and 48.

Figure 5:
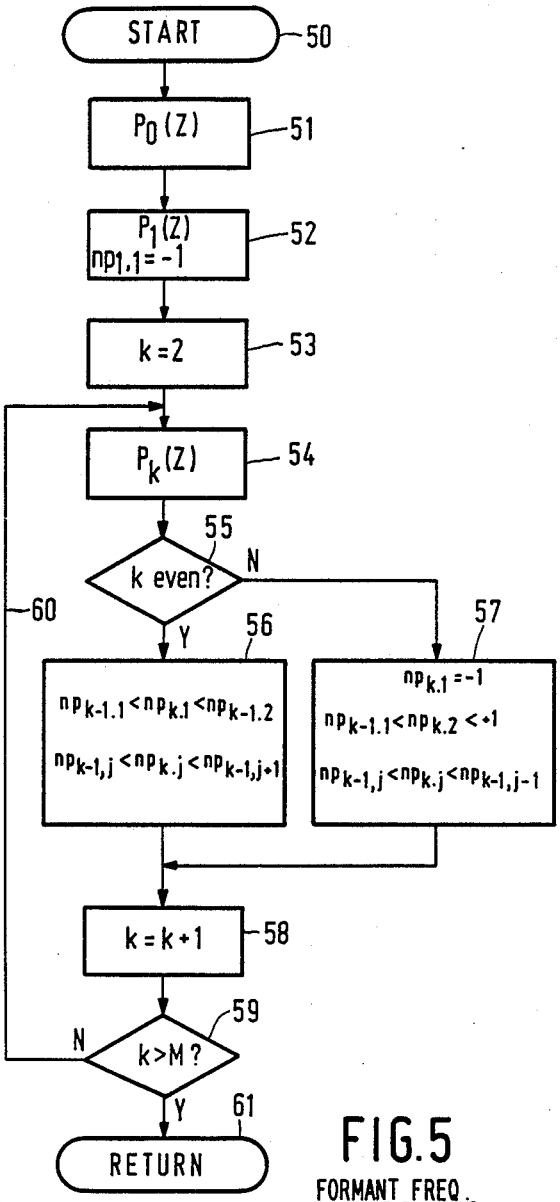
FIG. 5 is a flow chart of the programme section in which the Split Levinson algorithm is used.

FIG. 5 is a further elaboration of block 43 of FIG. 4. FIG. 5 shows a flow chart of the Split Levinson algorithm as outlined hereinbefore. The programme starts in block 50. $P_o(z)$ and $P_1(z)$ are calculated in the blocks 51 and 52, respectively. The zero of $P_1(z)$ $np_{1,1}$ is located at $z^{-1}=-1$. Subsequently k=2 is taken (block 53) and the singular predictor polynomial $P_k(z)$ is calculated in block 54 in accordance with formula (8). Dependent on the question whether k is even or odd (block 55), the zeros $np_{k.1}$, $np_{k.2}$ are either determined in accordance with block 56 or in accordance with block 57. Subsequently the value k is increased by 1 (block 58) and the programme returns via 59 and the chain 60 to block 54 to pass through the next recursion step. After the last recursion step (k=M) the programme leads via 59 to block 61 and the programme is ended.

Figure 6:
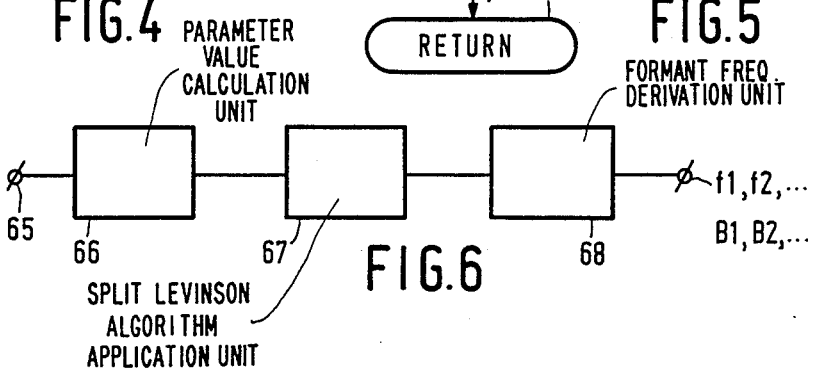
FIG. 6 shows a device for performing the method.

FIG. 6 shows an embodiment of the device according to the invention for performing the method. A speech signal is applied to the device via the input terminal 65. In the first unit 66 a part of the speech signal located within a given time interval is used to calculate a parameter value, for example the auto correlation coefficient for successive instants located within this time interval. These parameter values are applied to a second unit 67. This unit 67 applies the Split Levinson algorithm to the supplied parameter values. The zeros obtained in the last recursion step of the Split Levinson algorithm are applied to the third unit 68 deriving formant frequencies therefrom. In addition the third unit 68 may be adapted to calculate the associated bandwidths. The results are presented to an output 69 of the third unit 68.

It is to be noted that various modifications of the method and the device shown are possible without departing from the spirit and scope of the invention as defined in the Claims.

TABLE

Inscriptions in the flow charts of FIGS. 4 and 5

| block number | inscription |
|---|---|
| 40, 50 | start |
| 41 | derive speech segment |
| 42 | determine auto correlation coefficients |
| 43 | determination of zeros in Split Levinson algorithm |
| 44 | calculate formant frequencies |
| 45 | calculate corresponding bandwidths |
| 48 | stop |
| 54 | calculate singular predictor polynomial |
| 55 | k even? |
| 56, 57 | determination of zeros |
| 61 | return |

LIST OF LITERATURE (1) Philips' Elcoma technical publication no. 101 (1983) MEA 8000 voice synthesizer: principles and interfacing.

(2) Philips' Elcoma technical publication no. 217 (1986) Speech synthesis: the complete approach with the PCF 8200.

(3) Vogten, L. L. M. (1983) Analyse, zuinige kodering en resynthese van spraakgeluid. Dissertatie, Eindhoven.

(4) Delsarte, P. and Genin, Y. V. (1986) The Split Levinson Algorithm. IEEE Trans. on ASSP, Vol. ASSP-34, No. 3, Jun. 86, p. 470–478.

(5) Markel, J. D. and Gray, A. H. (1976) Linear prediction of speech Springer Verlag.

(6) Hilderbrand, F. B., Introduction to numerical analysis. McGraw Hill (1956).

(7) Sugamura, N. en Itakura, F., Speech analysis and synthesis methods develped at ELL in NTT - From LPC to LSP, in Speech Communication Vol. 5, 1986, p. 199–215.

What is claimed is:

1. A method of determining formant frequencies in a part of a speech signal located within a given time interval, which comprises:

deriving parameter values for successive instants located within the time interval from the part of the speech signal located within the time interval, determining a polynomial of a given order from the parameter values, deriving the formant frequencies in the speech signal from said polynomial, characterized in that a Split Levinson algorithm is performed in each of a number of successive recursion steps to determine a singular predictor polynomial from the parameter values, the singular predictor polynomial determined in a recursion step having a higher order than the singular predictor polynomial determined in a preceding recursion step, and wherein a recursion step includes deriving a number of zeros of the singular predictor polynomial determined in said recursion step by using the zeros calculated during a previous recursion step and, after the last recursion step, deriving the formant frequencies from the zeros of the singular predictor polynomial obtained in the last recursion step.

2. A method as claimed in claim 1 which comprises, for each of the derived formant frequencies and starting from the parameter values and the calculated formant frequencies, determining an associated bandwidth by means of a minimizing algorithm.

3. A method as claimed in claim 2, characterized in that the parameter value is the value of the auto correlation coefficient.

4. A method as claimed in claim 1 wherein the parameter value is the value of the auto correlation coefficient.

5. A device for determining formant frequencies from a part of a speech signal located within a given time interval, comprising:

an input terminal for receiving a speech signal, a first unit for deriving from said part of the speech signal respective parameter values for successive instants located within the given time interval, said first unit having an input coupled to the input terminal and an output coupled to an input of a second unit, said second unit including means for determining a polynomial of a given order from the parameter values and having an output coupled to an input of a third unit, and said third unit includes means for deriving the formant frequencies from the given polynomial, and having an output for supplying the formant frequencies, characterized in that the second unit performs a number of recursion steps in each of which a Split Levinson algorithm is performed to derive a singular predictor polynomial from the parameter values, the singular predictor polynomial derived in a recursion step having a higher order than the singular predictor polynomial determined in a preceding recursion step, wherein in a recursion step the second unit derives a number of zeros of the singular predictor polynomial determined in said recursion step by using zeros calculated during a previous recursion step, and in that the third unit derives the formant frequencies from the zeros of the singular predictor polynomial obtained in the last recursion step.

6. A device as claimed in claim 5 characterized in that the third unit further comprises means for determining an associated bandwidth for each of the derived formant frequencies, starting from the parameter values and the calculated formant frequencies, by means of a minimizing algorithm.

7. A method of determining the formant frequencies of a speech signal comprising:

converting an acoustic speech signal into a corresponding electric speech signal, deriving electric parameter values for successive time instants located within a given time interval which occurs over a part of the electric speech signal, deriving a singular predictor polynomial from the electric parameter values by means of a plurality of successive recursion steps in each of which a Split Levinson algorithm is performed, wherein a recursion step includes deriving a number of zeros of the singular predictor polynomial determined in said recursion step by using the zeros calculated during a previous recursion step and, after the last recursion step, deriving the formant frequencies in the speech signal from the zeros of the singular predictor polynomial obtained in the last recursion step.

8. A method as claimed in claim 7 which comprises the further step of determining an associated bandwidth for each of the derived formant frequencies, wherein, starting from the parameter values and the formant frequencies, the bandwidths are determined by means of a minimizing algorithm using the bandwidths as unknown quantities.

9. A method as claimed in claim 7 which further comprises, after the formant frequencies are determined for said part of the speech signal, sampling another part of the speech signal and then repeating the steps of claim 7 for said another part of the speech signal to determine the formant frequencies thereof.

* * * * *